US006238041B1

(12) United States Patent
Hasegawa

(10) Patent No.: US 6,238,041 B1
(45) Date of Patent: May 29, 2001

(54) HEAT-GENERATOR SUPPORTING MEMBER FOR INK-JET HEAD AND INK-JET HEAD EMPLOYING THE SAME

(75) Inventor: Kenji Hasegawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/881,663

(22) Filed: Jun. 24, 1997

(30) Foreign Application Priority Data

Jun. 26, 1996 (JP) ..... 8-185435
Jun. 26, 1996 (JP) ..... 8-185439

(51) Int. Cl.[7] ..... B41J 2/05
(52) U.S. Cl. ..... 347/63; 347/54; 347/56; 347/62; 347/64
(58) Field of Search ..... 347/54, 56, 63, 347/62, 64

(56) References Cited

U.S. PATENT DOCUMENTS 4,723,129 * 2/1988 Endo et al. ..... 347/56
5,216,448 6/1993 Unosawa et al. ..... 347/56
5,469,200 * 11/1995 Terai ..... 347/63
5,557,313 * 9/1996 Nakayama et al. ..... 347/203

FOREIGN PATENT DOCUMENTS

566116 * 10/1993 (EP) ..... 347/63
59-143650 8/1984 (JP) .
60-109850 6/1985 (JP) .
362053842 * 3/1987 (JP) ..... 347/63
62-253457 11/1987 (JP) .
405338174 * 12/1993 (JP) ..... 347/63

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

The heat-generator supporting member of the present invention for an ink-jet head comprises a support comprising a metal, a heat-generating resistance layer for generating thermal energy to be utilized in ink discharge by supply of electric current, an electrode layer electrically connected to the heat-generating resistance layer, a heat-accumulating layer provided under and in direct contact with the heat-generating resistance layer, and a protective layer formed by surface modification of the heat-generating resistance layer and the electrode layer, wherein the heat accumulating layer comprises a plurality of layers comprising a lower layer formed from a silicon oxide film prepared by no-bias sputtering and an upper layer formed from a silicon nitride film or from a silicon oxide film prepared by bias sputtering.

4 Claims, 2 Drawing Sheets

HEAT-GENERATOR SUPPORTING MEMBER FOR INK-JET HEAD AND INK-JET HEAD EMPLOYING THE SAME

BACKGROUND OF THE INVENTION

1. Field of the Invention

The present invention relates to a heat-generator supporting member for a recording head of an ink-jet recording system, which is excellent in durability, suitable for mass production, and particularly suitable for a long head such as a full-line type head.

2. Related Background Art

The ink-jet system is attracting attention in recent years owing to capability for printing at a high speed and a high density, suitability for color printing, and compactness of the system.

FIG. 1 shows the construction of an ink-discharging portion and its vicinity of a typical conventional ink-jet head.

In FIG. 1, the numeral 1 denotes a support which supports structurally a heat-generating resistor. The support is required to have a high thermal conductivity for diffusing excess heat generated at the heat-generating resistor to rapidly cool a heat-generating portion and its vicinity to a certain temperature or lower after completion of the pulse application for bubbling and discharge. The smooth surface of the support and the smooth surface of the heat-generating portion are important for providing uniform bubbling with high energy at the heat-generating portion for a stable ink discharge. Furthermore, the flat surface of the support is an important factor for forming a fine pattern for heat-generating resistors, electrodes, nozzles, and the like. As the support, a single-crystal silicon wafer is usually used.

In FIG. 1, the numeral 2 denotes a heat-accumulating layer. The heat-accumulating layer inhibits heat transfer to the support and allows the generated heat to efficiently act on the ink. Therefore, the heat-accumulating layer requires a low thermal conductivity in contrast to the support. The heat-accumulating layer requires heat resistance since it is in direct contact with the heat-generating resistor. Furthermore, the heat-accumulating layer requires an insulating property to inhibit electric conduction between the resistors and between electrodes. The heat-accumulating layer is usually formed from an insulating material, in particular, silicon oxide having a low heat conductivity, or the like.

In FIG. 1, the numeral 3 denotes a heat-generating resistance layer (heat-generating resistor). The heat for bubbling of the ink is generated by application of electric pulses to the portion of the heat-generating resistance layer 3 between a common electrode 4 and individual electrodes 4' each connected electrically to a driving circuit and a power source (not shown in the drawing). The heat-generating resistor requires heat resistance, suitable specific resistivity, and stability of the resistance, and is usually made of materials such as $HfB_2$, TaAl, or the like. The electrodes 4, 4' are usually made of a material having a low resistivity such as Al on Au.

In FIG. 1, the numeral 5 denotes a protective layer. The protective layer separates the electrodes and the heat-generating resistor from an electroconductive ink to carry out insulation from the ink and to prevent electrochemical damage from being caused by the ink. The protective layer serves also as an oxidation inhibiting layer for the heat-generating resistor. The protective layer requires heat-resistant and insulating properties, and is usually made of materials such as silicon oxide, silicon nitride, or the like.

In FIG. 1, the numeral 6denotes an anti-cavitation layer. The anti-cavitation layer protects the heat-generating resistor from damage caused by cavitation upon extinction of the bubbles. The anti-cavitation layer is usually made of a metal having a strong resistance to cavitation erosion such as Ta. The anti-cavitation layer also requires chemical stability in addition to the anti-cavitation-erosion property since it is brought into contact with the ink at a high temperature.

Additionally, a protective layer (e.g., organic protection layer, etc.) may be optionally provided by coating on a region except the heat-generating portion to prevent damage to the electrode caused by pinholes in the protective layer 5 and the anti-cavitation layer 6.

On such a heat-generator supporting member 7, liquid flow paths 8 each corresponding to respective heat-generating resistors and communicating to a recording liquid feed opening (not shown in the drawing), and discharging orifices 9 are formed to complete an ink-jet head 10.

The constitution of the heat-generator supporting member at and around the discharging portion is similar to that of a conventional thermal head. However, the thermal and chemical characteristics required for the heat-generator supporting member are severer than the characteristics required for the thermal head because it is in direct contact with a liquid, because it is subjected to mechanical impact (cavitation erosion) caused by repeated bubble formation and bubble extinction, and because it is subjected to increase and decrease of temperature of several 100 ° C. to 1000 ° C. in a short time of several microseconds.

By a fine pattern formation technique such as photolithography, the ink-jet head having the aforementioned constitution can readily be formed with higher density of the head (several tens of nozzles per millimeter) and higher integration degree (several hundred nozzles per head). Therefore, it can perform recording of very high quality and higher speed recording owing to the especially higher frequency (several to several-ten kHz) of discharging ink droplets in comparison with a recording speed of thermal head or the like. The aforementioned ink-jet head has many excellent characteristics such as applicability to color recording, compactness of the head, and low running cost.

It is required that the ink-jet head having excellent characteristics as mentioned above has capability of higher speed recording as the results of the progress in processing ability of computers and the increase of the amount of information.

For higher speed recording, the number of the nozzles of the head may be increased simply. However, the increase of the number of the nozzles results in increase of the length of the head, causing the problems discussed below.

Conventionally, a single-crystal Si wafer is used as the support, as mentioned above. The single-crystal Si wafer has advantages that it is readily available, and yet has high heat resistance, high thermal conductivity, high surface smoothness, and high planarity. It can be processed by a film-forming apparatus, a patterning apparatus, and the like of a conventional semiconductor process. The driving IC can be incorporated into the support, and so forth. However, a long one-chip head is not producible from the single-crystal Si wafer, disadvantageously.

From an 8-inch Si wafer readily available at the moment, a full-line type head of A4-size paper sheet breadth cannot be produced as one chip. A larger wafer is required therefor. However, general type processing machines cannot process such a larger wafer. A less number of such long supports can be produced from a disk-shaped wafer, which results in a remarkable increase of the cost. Therefore, to produce a long head from an Si wafer, it is necessary to construct one long head from a plurality of chips (supports), or one long head from a plurality of heads. However, the positional registration cannot readily be conducted. The difficulty in the registration increases greatly with increase of the recording density and to meet the requirement for higher recording quality. Therefore, a material for a long support in place of the Si wafer is demanded for production of a long ink-jet head.

It is required that a heat-accumulating layer 2 composed of a low thermal conductivity is provided in a layer as shown FIG. 1 as mentioned above. When an Si wafer is employed as the support, a thermally oxidized $SiO_2$ film formed by modifying the surface of the wafer itself can be used as the heat-accumulating layer. Otherwise, when the support of a metal or the like is employed, it is necessary to form on the support a film of a material such as silicon oxide or the like having an insulating property, a heat resistant property, and a low thermal conductivity by sputtering, CVD, or a like method since the modified surface of the support has usually high thermal conductivity unsuitable for the heat-accumulating layer. However, the film formed by physical vapor deposition, chemical vapor deposition, coating-and-firing, or the like is generally inferior in film properties such as chemical stability in comparison with thermally oxidized $SiO_2$.

It was found by the inventor of the present invention that the difference of the film quality can greatly affect the durability of the heat-generating resistor of the ink-jet head. A lower film quality of the heat-accumulating layer tends to increase the change of resistivity of the heat-generating resistor of the head during the driving, resulting in early breakdown. It is necessary to form the heat-accumulating layer having a film quality as high as possible.

When the heat-accumulating layer of the ink-jet head for effective discharge is formed from silicon oxide or the like, it requires at least a thickness ranging from 1.5 $\mu$m to 2 $\mu$m depending on the driving pulse breadth. With such a dimension of the thickness, the stress built up in the film at the film formation affects greatly the support. For example, excessive stress in the film may cause warpage of the support, or exfoliation of the film to cause a serious problem in the production process.

Accordingly, it is necessary to control the film stress in the heat-accumulating layer as well as the film quality. The control of the film stress is more important for a longer head and a larger support. Generally, the quality of the film formed by sputtering, CVD, or the like can be improved by elevating the support temperature during the film formation, or by formation of the film with application of impact with ions. However, the film formation at a higher support temperature causes stronger internal stress at room temperature owing to the difference between the thermal expansion coefficient of the support and the film material to cause warpage of the support. Thus, simultaneous control of the high film quality and the weak film stress is often achieved with large difficulty.

A conventional ink-jet head has also a protective film made of silicon oxide, silicon nitride, or the like on the heat-generating resistor and the electrode as shown in FIG. 1. In such a type of ink-jet head, it is extremely difficult to prevent completely the generation of defects (pinholes) caused during the protection film formation, which lowers the yield of the ink-jet heads in mass production. This problem becomes more serious with the increase of the length and area of the head. The formation of pinholes can be prevented to some extent by increasing the thickness of the protective layer. However, the larger thickness of the protective layer leads to a larger power consumption for ink discharge and a larger temperature change of the entire head on driving. The temperature change of the head causes a change of the volume of the discharged liquid, resulting in image density irregularity.

Increase of the driving frequency for increasing the recording speed causes further increase of the power consumption of the head to make more remarkable the irregularity of the image density by temperature variation. This is contradictory to the requirement for higher quality of the recorded image and is a problem to be solved.

Japanese Patent Application Laid-Open No. 59-143650 and No. 60-109850 disclose that the surface layers of the heat-generating resistor and the electrodes are modified into an inorganic insulating layer to use it as the protective layer. According to this method, it is possible to form a thin protective film without defects. This method is very excellent in easy treatment of a larger area of the layer and simple process.

The inventor of the present invention found formerly that the above method is more effectively carried out by using the heat-generating resistor of a Ta-Al alloy.

Further, the inventor of the present invention found that the aforementioned problem of the film quality of the heat-accumulating layer is more serious in durability of the heat-generator supporting member for an ink-jet head produced by the above method. That is, the quality of the heat-accumulating layer is directly reflected to the durability of the heat-generating resistor in the heat-generator supporting member for the ink-jet head having a thin protective film formed by modification of the heat-generating resistor or electrode itself in place of the conventional thick protective film made of silicon oxide, silicon nitride, or the like. Therefore, the requirement for the accumulating layer quality is more severe in this type of the heat-generator supporting member. This is a great obstacle in a long head in which a thermally oxidized $SiO_2$ film of high quality cannot be utilized as the heat-accumulating layer.

SUMMARY OF THE INVENTION

An object of the present invention is to provide a heat-generator supporting member of an ink-jet head which solves the aforementioned disadvantages of the conventional ink-jet head, which is suitable for a long head capable of fine recording at a high recording speed, and which is excellent in high productivity and high reliability.

According to an aspect of the present invention, there is provided a heat-generator supporting member for an ink-jet head comprising: a support comprising a metal; a heat-generating resistance layer for generating thermal energy to be utilized in ink discharge by supply of electric current; an electrode layer electrically connected to the heat-generating resistance layer; a heat-accumulating layer provided under and in direct contact with the heat-generating resistance layer; and a protective layer formed by surface modification of the heat-generating resistance layer and the electrode layer, wherein the heat-accumulating layer comprises a plurality of layers comprising a lower layer formed from a silicon oxide film prepared by no-bias sputtering and an upper layer formed from a silicon nitride film or from a silicon oxide film prepared by bias sputtering.

According to another aspect of the present invention, there is provided an ink-jet head comprising: a heat-generator supporting member for an ink-jet head comprising a support comprising a metal, a heat-generating resistance layer for generating thermal energy to be utilized in ink discharge by supply of electric current, an electrode layer electrically connected to the heat-generating resistance layer, a heat-accumulating layer provided under and in direct contact with the heat-generating resistance layer, and a protective layer formed by surface modification of the heat-generating resistance layer and the electrode layer; a discharging orifice for discharging an ink; and a liquid flow path communicating with the discharging orifice, wherein the heat-accumulating layer comprises a plurality of layers comprising a lower layer formed from a silicon oxide film prepared by no-bias sputtering and an upper layer formed from a silicon nitride film or from a silicon oxide film prepared by bias sputtering.

DESCRIPTION OF THE PREFERRED EMBODIMENT

The aforementioned object of the present invention can be achieved by the heat-accumulating layer provided on a support, the heat-accumulating layer being constituted of a plurality of layers comprising an upper layer brought into direct contact with a heat-generating resistor and ink and formed from a material having chemical stability, thermal stability, insulating property, adhesiveness to the heat-generating resistor; and a lower layer having low thermal conductivity and weak film stress and mainly exhibiting a heat accumulation effect.

The upper layer has a thickness for achieving the effects of chemical stability, thermal stability, insulating property, adhesiveness to the heat-generating resistor, and the thickness is usually about 0.2 $\mu$m or more. Therefore, a material having a large film stress may be used. The lower layer having weaker film stress makes up for the insufficient heat accumulation effect of the upper layer. Thereby, the restriction of film stress to the upper layer, and of chemical and thermal stability to the lower layer are reduced, and the material can be selected practically from a wider range of materials.

The present invention is described in more detail with reference to preferred embodiments.

Figure 1:
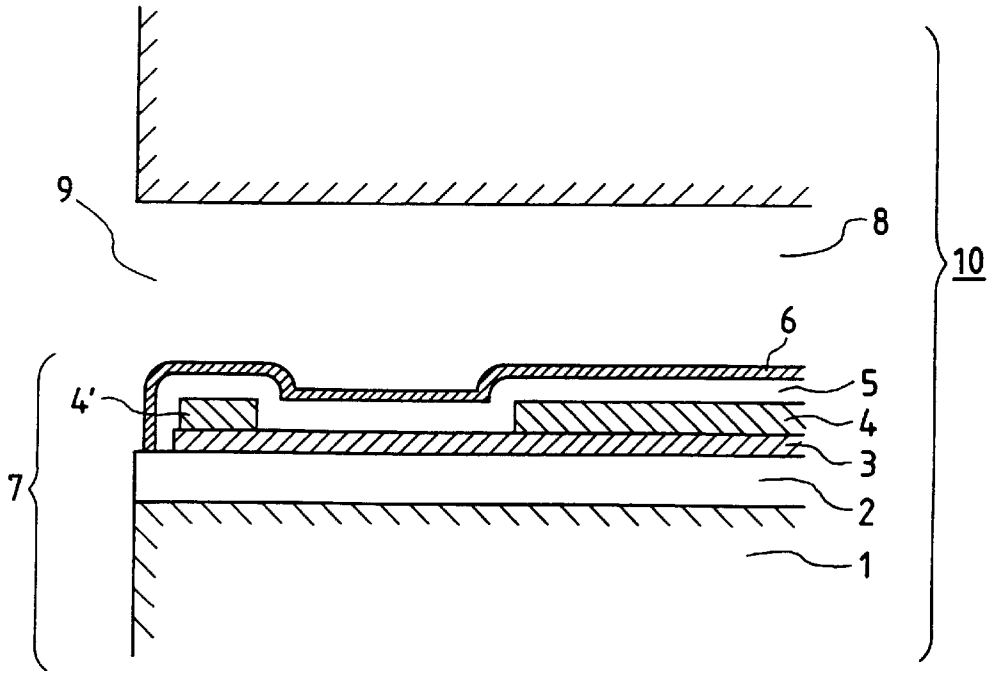
FIG. 1 PRIOR ART
FIG. 1 is a cross-sectional view showing the constitution of a discharging portion and the vicinity thereof of an ink-jet head of a typical conventional ink-jet head.
Figure 2:
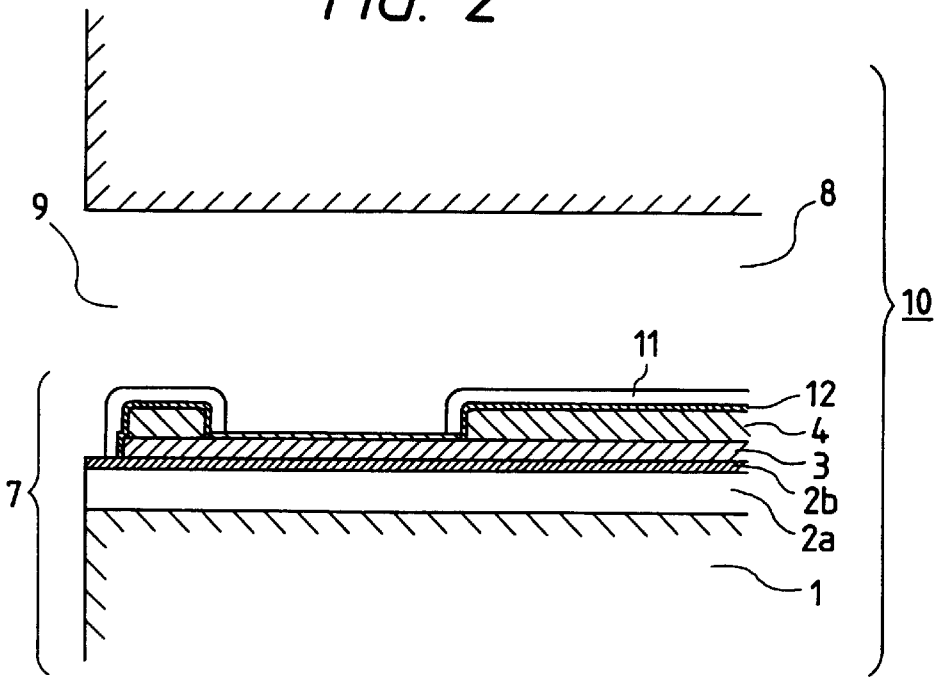
FIG. 2 is a cross-sectional view showing the constitution of a discharging portion and the vicinity thereof of an ink-jet head of the present invention.

FIG. 2 shows a preferred embodiment of the present invention. The support 1 for the heat-generator supporting member for an ink-jet head of the present invention may be made of any material which satisfies the above requirement for the support. As a material of a large area for producing a long one-chip head or the like, a support of a metal such as aluminum is useful in consideration of the thermal conductivity, the workability, the cost, and so forth. An alumina support useful for the thermal head supporting member is not useful for the ink-jet head supporting member because the alumina support is a sintered article having many concave portions caused by falling-off of particles during polishing. A glass support useful for a liquid crystal display is not suitable for the ink-jet head driven at a high speed because of the low thermal conductivity.

The heat-accumulating layer 2, which is the most important feature of the present invention, is constituted of a plurality of layers having separate functions as mentioned above. It is important that the lower layer 2*a* formed at the side of the support requires a low thermal conductivity and a weak film stress, and some heat resistance. The preferred material therefor includes silicon oxide formed by sputtering or plasma CVD. The requirements for the film quality such as chemical and thermal stability of the lower layer are not severe, so that the temperature of the support during the film formation can be kept low. When the temperature of the support is elevated during the layer formation, a large stress is caused at room temperature and the support may be warped owing to the difference of the thermal expansion coefficients between the support and the film. When the entire heat-accumulating layer is formed only from the material of the lower layer 2*a* without the upper layer 2*a*, the quality of the film is not sufficient, and the durability of the heat-generating resistor becomes low.

The upper layer 2*b* of the heat-accumulating layer having a plurality of layers in the present invention is brought into direct contact with the heat-generating resistor or the recording agent such as an ink. The important properties required to the upper layer 2*b* includes chemical stability, thermal stability, insulating property, adhesiveness to the heat-generating resistor at high temperatures. The thickness of the upper layer is determined to obtain the above properties, and is usually about 0.2 $\mu$m or more. Therefore, larger film stress can be acceptable. Since the lower layer 2*a* has heat accumulation effect, the upper layer need not have thermal conductivity as low as the lower layer. However, in the formation of the upper layer, a high temperature of the support is not preferred, because the lower layer formed at a low temperature becomes a stress-relaxed state at a high temperature, and the stress caused by the thermal expansion coefficient in the lower layer 2*a* rises at room temperature to cause warpage of the support.

The preferred material for the upper layer 2*b* satisfying the aforementioned properties by the film formation at a low temperature includes silicon nitride films formed by sputtering or plasma CVD and silicon oxide films formed by bias sputtering. The silicon nitride films formed by sputtering or plasma CVD and the silicon oxide films formed by bias sputtering, which are excellent in the properties of chemical stability, thermal stability, insulating property, adhesiveness to the heat-generating resistor, tend to have large internal stress in comparison with the silicon oxide films formed by sputtering or plasma CVD, and tend to cause warpage of the support when the heat-accumulating layer 2 is formed only from the above former films in a thickness of 2 $\mu$m or more. Moreover, the former films have higher thermal conductivity than the latter silicon oxide films to lower the energy efficiency. To avoid such problems, the thickness of the former films including the silicon nitride films is preferably controlled to be not more than 1 $\mu$m.

The heat-generating resistor 3 and the electrodes 4 formed on the aforementioned heat-accumulating layer 2 is preferably modified at the surface by a treatment such as anodization to form an insulating protective layer 12.

By using a material selected for the heat-generating resistor and the electrodes as described above, a suitable simple production process is applicable for producing a long head having a high thermal efficiency with less defects as described in Japanese Patent Application Laid-Open No. 59-143650 and No. 60-109850 mentioned above. The heat-accumulating layer 2 of the present invention is especially effective for the heat-generator supporting member for the ink-jet head produced by the above production process.

A particularly suitable heat-generating resistor is the one made from a Ta-Al alloy. A particularly suitable electrode is the one composed mainly of Al. Such a heat-generating resistor or an electrode can be formed into a film by a known process such as sputtering and vapor deposition, and can be patterned by a known method such as photolithography.

The insulating protective layer 5 can be formed by modifying the surface of the heat-generating resistor and the surface of the electrode, for example, by anodization in an electrolyte solution. This process can be conducted with a simple apparatus, and is suitable for treating the support of a large size. Further, formation of a coating type protective layer 11 preferably on the region except the heat-generating portion is useful for improvement of the reliability and handling properties.

The heat-generator supporting member 7 for the ink-jet head of the present invention is completed in a manner as described above.

On the thus formed heat-generator supporting member 7 for the ink-jet head, liquid flow paths 8, discharging orifices 9, and so forth can be formed in a known manner such as disclosed in Japanese Patent Application Laid-Open No. 62-253457 to complete an ink-jet head. An ink-jet recording apparatus is completed by connecting an ink-feeding system and a driving system (both being not shown in the drawing) to the ink-jet head.

The present invention is described in more detail with reference to Examples.

EXAMPLE 1

An ink-jet head of the present invention was produced as below.

As the support, an Al base plate having a mirror-polished Al surface (Trade No.: 5386, size: 330×150×2 mm) was used. On the polished surface, a silicon oxide film was formed as the lower layer of the heat-accumulating layer in a thickness of about 2.2 μm, and a silicon nitride film was formed as the upper layer of the heat-accumulating layer in a thickness of about 0.3 μm, by no-bias RF sputtering. Thereon, a heat-generating resistance layer of a Ta-Al alloy was formed in a thickness of about 0.25 μm by DC sputtering with a Ta-Al composite target. Further, thereon, an Al layer for the electrodes was formed in a thickness of about 1 μm by DC sputtering.

The patterning for the electrodes and the patterning for the heat-generating resistor were conducted successively by photolithography and RIE (reactive ion etching) to form a pattern having heat-generating portions in a size of 20×100 μm and a pitch of 63.5 μm over the A4 breadth (210 mm) (about 3300 segments).

A photoresist mask was formed thereon by photolithography on the contact point portions and other portions where the oxide film is not to be formed. Then, anodization treatment was conducted in an aqueous ammonium tartarate solution by using a platinum counter electrode to form an insulating protective layer on the surfaces of the electrodes and the heat-generating resistor. The anodization was conducted firstly at a constant current of 10 mA/cm$^2$, and after the voltage reached to 100 V, the anodization was continued at the voltage kept constant for 10 minutes. The resulting insulating protective layer is estimated to have a thickness of about 0.15 μm.

After the anodization treatment, an organic protective layer was formed in a thickness of about 2 μm on the region except the heat-generating portions and the electric contact points by using a resin capable of patterning (trade name: Photonease UR-3100, Toray Industries, Inc.) by photolithography. Thus, a heat-generator supporting member for the ink-jet head was completed.

On this heat-generator supporting member, liquid flow paths, discharging orifices, a common liquid chamber, and so forth were formed by the process disclosed in Japanese Patent Application Laid-Open No. 62-253457 to obtain an ink-jet head capable of recording over the A4 breadth as shown in FIG. 2.

EXAMPLE 2

An ink-jet head was prepared in the same manner as in Example 1 except that the upper layer of the heat-accumulating layer was an silicon oxide film formed by bias sputtering by application of −100 V bias voltage to the base plate (support) side.

Comparative Example 1

An ink-jet head was prepared in the same manner as in Example 1 except that the heat-accumulating layer was constituted only of one silicon oxide layer formed by no-bias sputtering which was the same as the lower layer of the heat-accumulating layer in Example 1 and had a thickness of about 2.5 μm.

Comparative Example 2

Production of an ink-jet head was started in the same manner as in Example 1 except that the heat-accumulating layer was constituted only of one silicon nitride layer which was the same as the upper layer of the heat-accumulating layer in Example 1 and had a thickness of about 2.5 μm. However, after formation of the heat-accumulating layer, the base plate warped greatly. Therefore, the production of the ink-jet head was discontinued.

Comparative Example 3

An ink-jet head was prepared in the same manner as in Example 2 except that the thickness of the silicon oxide film formed by no-bias sputtering was changed to 2.4 μm and the thickness of the silicon oxide film formed by bias sputtering was changed to 0.1 μm.

Comparative Example 4

Production of an ink-jet head was started in the same manner as in Example 1 except that the heat-accumulating layer was constituted only of one silicon oxide layer formed by bias sputtering at a bias voltage of −100 V which was the same as the upper layer of the heat-accumulating layer in Example 2 and had a thickness of about 2.5 μm. However, after formation of the heat-accumulating layer, the base plate warped greatly. Therefore, the production of the ink-jet head was discontinued.

The thus formed ink-jet heads of Examples 1 and 2, and Comparative Examples of 1 and 3 were evaluated in two tests (a) and (b) as described below.

(a) CST (Constant Stress Test):

The ink having the following composition was ready to be supplied to the formed liquid paths of the produced ink-jet head, and external driving circuit was connected to apply a rectangular pulse voltage of 10 μsec width. With gradual increase of the voltage of the pulse, the voltage for initiating the discharge of the ink from the discharging orifice (discharge threshold voltage Vth) was measured. Then, the ink was withdrawn from the head. The change of the resistance of the heat-generating resistor was measured by applying voltage pulse of 1.25 Vth.

| | |
|---|---|
| Water | 77 parts |
| Diethylene glycol | 20 parts |
| Black Dye (CI Food Black 2) | 3 parts |
| pH adjusting agent ($CH_3COONa$) | not more than 0.1 part |

(b) Discharge Duration Test:

Another head prepared was tested for Vth in the same manner as in (a) above, and then was subjected to ink discharge test by application of 1.2 Vth to discharge ink droplets in an ink amount corresponding to recording on 10,000 A4-paper sheets.

Before and after this ink discharge running test (initial stage and after discharge for 10,000 sheets), this head was tested for recording by mounting it on another recording apparatus, and the recorded matters like characters were evaluated visually.

Figure 3:
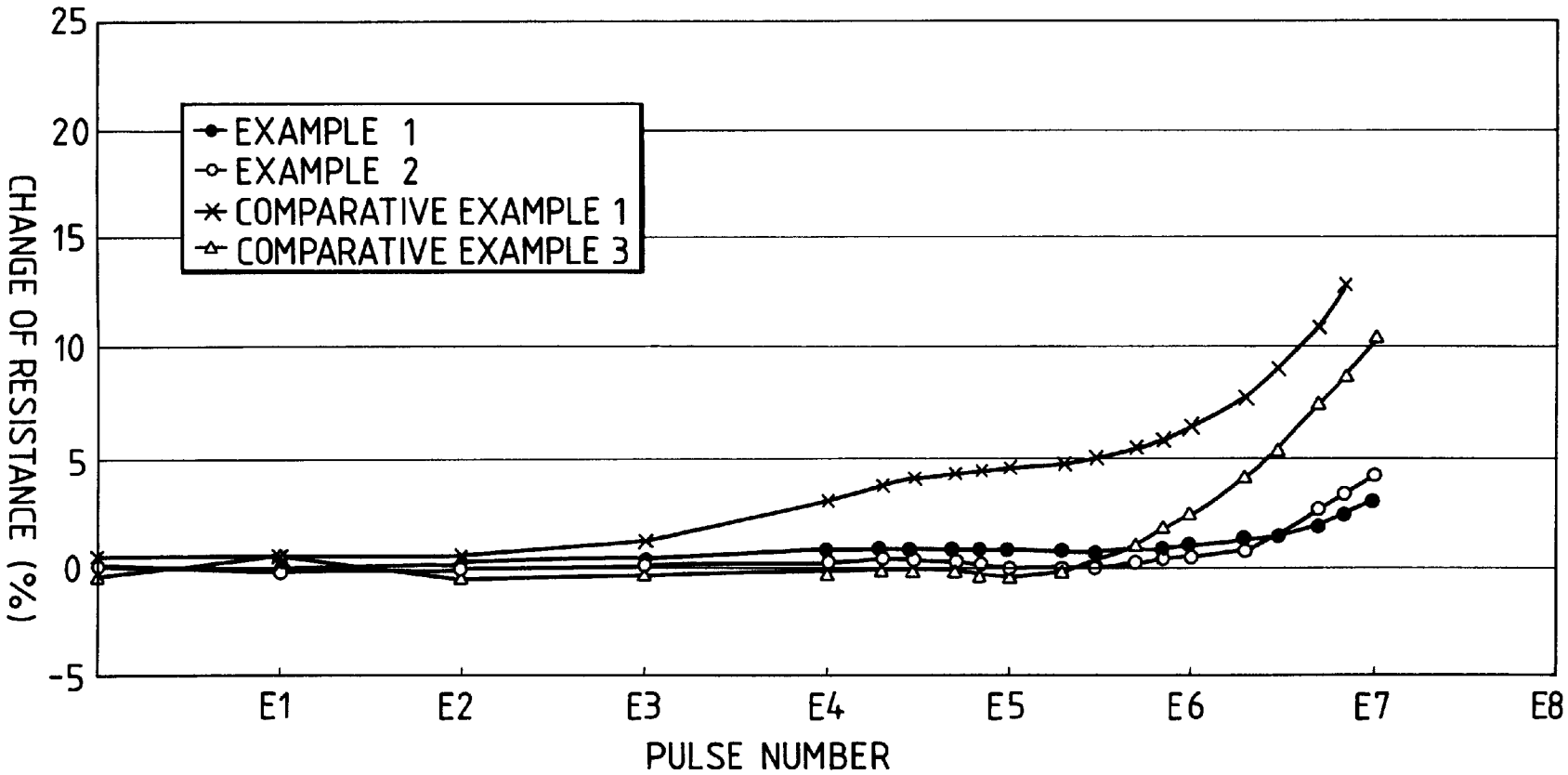
FIG. 3 is a graph showing the results of CST in Examples and Comparative Examples.

FIG. 3 shows the results of CST of several of the Examples and Comparative Examples. The heads of the Examples which have the heat-accumulating layer of two layer structure and has the upper layer of thermally stable silicon nitride or thermally stable silicon oxide formed by bias-sputtering are found to show smaller change of the resistance of the heat-generating resistor and high durability to thermal cycles on driving in comparison with the heads of Comparative Examples 1 and 3.

Table 1 shows the results.

TABLE 1

| | Ejection Durability Test | |
|---|---|---|
| | At initial stage | After ink ejection corresponding to 10,000 sheets |
| Example | | |
| 1 | A | A |
| 2 | A | A |
| Comparative Example | | |
| 1 | A | C |
| 3 | A | B |

Evaluation Symbols:

A: Recording being satisfactory

B: No ink discharge from some nozzles to cause defects like white streaks

C: No ink ejection from many nozzles to cause blurring of record

As clearly seen from Table 1, all of the four ink-jet heads had satisfactory recording characteristics at the initial stage. After the discharge duration test, the heads of the Examples had still the satisfactory recording characteristics, whereas the heads of Comparative Examples 1 and 3 did not give normal record owing to breakage of the heat-generating resistor. Presumably, this is caused by the difference in the chemical and thermal stability of the portions of the heat-accumulating layer in contact with the heat-generating resistor or with the ink.

In the present invention, the heat-accumulating layer is constituted of an upper layer having excellent chemical and thermal stability and excellent adhesiveness, and a lower layer having less film stress and less thermal conductivity to give excellent durability of the heat-generating resistor during running without a problem in the process such as warpage of the support or exfoliation of the film. The heat-generator supporting member for the ink-jet head of the present invention is suitable for a long ink-jet head, and is suitable for mass production.

What is claimed is:

1. A method of producing an ink-jet head comprising: a heat-generator supporting member made of a metal, the supporting member being provided with a heat-generating resistance layer for generating thermal energy to be utilized in ink discharge by supply of electric current, an electrode layer electrically connected to the heat-generating resistance layer, a heat-accumulating layer provided under and in direct contact with the heat-generating resistance layer, and a protective layer formed on a surface of said heat-generator supporting member by surface modification of the heat-generating resistance layer and the electrode layer; a discharging orifice for discharging ink; and a liquid flow path in communication with the discharge orifice; said method comprising:

forming the heat-accumulating layer by a step of forming a silicon oxide film on the supporting member made of the metal, by no-bias sputtering and a step of forming, on the silicon oxide, a silicon nitride film or a second silicon oxide film, prepared by bias sputtering.

2. The method of producing an ink-jet head according to claim 1, wherein the silicon nitride film or the second silicon oxide film formed by bias sputtering has a thickness of 0.2 $\mu$m to 1 $\mu$m and not larger than the thickness of the silicon oxide film formed by no-bias sputtering.

3. The method of producing an ink-jet head according to claim 1, wherein the protective film is formed from an organic material at a portion other than a heat-generating portion on the heat-generating resistance layer and the electrode layer.

4. The method of producing an ink-jet head according to claim 1, wherein the protective film is formed by anodization.

* * * * *

UNITED STATES PATENT AND TRADEMARK OFFICE

CERTIFICATE OF CORRECTION

PATENT NO. : 6,238,041 B1
DATED : May 29, 2001
INVENTOR(S) : Kenji Hasegawa

It is certified that error appears in the above-identified patent and that said Letters Patent is hereby corrected as shown below:

Column 1,
Line 38, “conductivity” should read -- conductivity, --; and
Line 58, “on” should read -- or --.

Column 2,
Line 1, “6denotes” should read -- 6 denotes --; and
Line 65, “less” should read -- lower --.

Column 3,
Line 6, “and” should be deleted.

Column 6,
Line 23, “includes” should read -- include --; and
Line 55, “is” should read -- are --.

Column 7,
Line 56, “counter electrode” should read -- counter-electrode --.

Column 8,
Line 15, “an” should read -- a --.

Column 9,
Line 5, “Water” should read -- Ink Composition: ¶Water --; and
Line 23, “has” should read -- have --.

Signed and Sealed this

Twenty-fourth Day of June, 2003

JAMES E. ROGAN
*Director of the United States Patent and Trademark Office*